US011187034B2

(12) United States Patent
Lei et al.

(10) Patent No.: US 11,187,034 B2
(45) Date of Patent: Nov. 30, 2021

(54) DRIVING MECHANISM FOR CURTAIN CORD WINDING REELS

(71) Applicant: Leafy Windoware Co., Ltd., Dongguan (CN)

(72) Inventors: Zhenbang Lei, Guangdong (CN); Xingbang Lei, Guangdong (CN)

(73) Assignee: Leafy Windoware Co., Ltd., Dongguan (CN)

( * ) Notice: Subject to any disclaimer, the term of this patent is extended or adjusted under 35 U.S.C. 154(b) by 250 days.

(21) Appl. No.: 16/326,926

(22) PCT Filed: Jun. 13, 2017

(86) PCT No.: PCT/CN2017/088136
§ 371 (c)(1),
(2) Date: Feb. 21, 2019

(87) PCT Pub. No.: WO2018/205338
PCT Pub. Date: Nov. 15, 2018

(65) Prior Publication Data

US 2019/0211624 A1 Jul. 11, 2019

(30) Foreign Application Priority Data

May 9, 2017 (CN) ..... 201720510800.7

(51) Int. Cl.
*E06B 9/60* (2006.01)
*E06B 9/68* (2006.01)
(Continued)

(52) U.S. Cl.
CPC ..... *E06B 9/60* (2013.01); *A47H 5/02* (2013.01); *A47H 11/06* (2013.01); *E06B 9/322* (2013.01);
(Continued)

(58) Field of Classification Search
CPC ... E06B 9/60; E06B 9/68; E06B 9/322; E06B 9/262; E06B 2009/3222; E06B 2009/3225;
(Continued)

(56) References Cited

U.S. PATENT DOCUMENTS 7,740,045 B2 * 6/2010 Anderson ..... E06B 9/322 160/84.05
8,230,896 B2 * 7/2012 Anderson ..... E06B 9/32 160/170
(Continued)

*Primary Examiner* — Daniel P Cahn
*Assistant Examiner* — Poras Pradipkumar Patel

(57) ABSTRACT

A driving mechanism for curtain cord winding reels includes a driving module, and first and second transition shafts mounted to two sides of the driving module. The driving module includes a base, a power member assembled in the base, and a middle shaft connected to the power member and mounted to two sides of the base. Two ends of the middle shaft extend out of the sides of the base and form a first shaft hole and a first axis. The first and second transition shafts are mounted to the ends of the middle shaft. An end of the first transition shaft connected to the middle shaft forms a second axis. An end of the second transition shaft connected to the middle shaft defines a second shaft hole. Cross sections of the first and second shaft holes, the first and second axes are matched with one another, and are non-circular.

8 Claims, 6 Drawing Sheets

(51) Int. Cl.

| | |
|---|---|
| ***A47H 5/02*** | (2006.01) |
| ***A47H 11/06*** | (2006.01) |
| ***E06B 9/322*** | (2006.01) |

(52) U.S. Cl.
CPC ..... *E06B 9/68* (2013.01); *E06B 2009/3225* (2013.01)

(58) Field of Classification Search
CPC .... E06B 2009/2627; A47H 5/02; A47H 11/06
See application file for complete search history.

(56) References Cited

U.S. PATENT DOCUMENTS

| | | | | |
|---|---|---|---|---|
| 8,752,607 | B2 * | 6/2014 | Anderson | E06B 9/262 160/84.05 |
| 8,939,190 | B2 * | 1/2015 | Mullet | E06B 9/323 160/176.1 P |
| 2017/0218695 | A1 * | 8/2017 | Hsu | E06B 9/322 |

* cited by examiner

DRIVING MECHANISM FOR CURTAIN CORD WINDING REELS

BACKGROUND OF THE INVENTION

1. Field of the Invention

The present invention relates to driving mechanisms for cord winding reels and, more particularly to a driving mechanism for curtain cord winding reels.

2. Description of Related Art

Curtains are common modern decorations for home or office. A traditional curtain is usually controlled by a drawstring to close or open the curtain. An end of the drawstring is wound on a cord winding reel of a coiling-and-uncoiling device. A driving mechanism of the coiling-and-uncoiling device drives the reel to rotate to wind or unwind the drawstring, so as to achieve the purpose of closing or opening the curtain.

A current driving mechanism for cord winding reels usually uses an elastic member to drive the reels to rotate. Taking the case of manually pulling the drawstring to close the curtain as an example, the drawstring is manually pulled to positively rotate the reels to wind the drawstring. The rotation of the reels will drive rollers coaxial with the reels of the driving mechanism to rotate positively, so as to deform the elastic member connected to the rollers. Therefore, binding the drawstring to a preset position can achieve the closing of the curtain. When the curtain needs to be opened, the drawstring is released, and the rollers are reversely rotated under the elastic action of the elastic member to drive the reels to reversely rotate. Therefore, the drawstring is unwound from the reels, and the curtain is then opened.

However, a current driving mechanism for cord winding reels is usually only configured with a single elastic member to drive the reels to rotate. In the case of a heavy curtain, the elastic effect of a single elastic member is not enough to achieve the closing of the curtain. It is difficult to coordinate the consistency of all driving mechanisms if multiple driving mechanisms are configured, and the assembly difficulty of the multiple driving mechanisms is increased.

SUMMARY OF THE INVENTION

Therefore, the technical problem to be solved by the embodiments of the present invention is to provide a driving mechanism for curtain cord winding reels, which is simple and reliable in structure, simplifies assembly of the driving mechanism, and improves the torque of the driving mechanism.

To solve the above-mentioned technical problems, an embodiment of the present invention provides a driving mechanism for curtain cord winding reels. The driving mechanism includes at least one driving module and first and second transition shafts respectively mounted to two sides of the at least one driving module and connected to the cord winding reels by drive connection. Each of the at least one driving module includes a base, a power member assembled in the base, and a middle shaft connected to the power member by drive connection and mounted to two sides of the base with first and second ends. The first and second ends of the middle shaft extend out of the sides of the base. An end surface of the first end defines a first shaft hole. The second end forms a first axis. The first and second transition shafts are respectively connected to the first and second ends of the middle shaft. An end of the first transition shaft connected to the middle shaft forms a second axis. An end of the second transition shaft connected to the middle shaft defines a second shaft hole. Cross sections of the first shaft hole, the second shaft hole, the first axis, and the second axis are matched with one another, and the cross sections are non-circular.

Furthermore, the power member is a clockwork spring, an inner end of the clockwork spring is connected to the base through a spring shaft, and an outer end of the clockwork spring is connected to the middle shaft.

Furthermore, the middle shaft includes two end plates formed at the first and second ends of the middle shaft, an outer surface of the middle shaft is connected to the outer end of the clockwork spring and cooperates with inner side surfaces of the two end plates to form a winding space for accommodating the clockwork spring.

Furthermore, the at least one driving module includes two or more driving modules, the two or more driving modules are connected in series to form a long strip of drive module group, the first axis at the second end of each of the two or more driving modules that are sequentially connected is engaged in the first shaft hole of the first end of the middle shaft of an adjacent driving module, the first axis of the second end of the driving module located at the foremost end of the driving module group is correspondingly engaged in the second shaft hole of the second transition shaft, the second shaft of the first transition shaft is engaged in first shaft hole of the first end of the driving module at the rear end of the drive module group.

Furthermore, the sides of the base form two end covers to define two limit spaces together with the base, to limit the first transition shaft and the second transition shaft, the end covers define through holes through which the first transition shaft and the second transition shaft respectively extend out of the corresponding limit spaces, ends of the first transition shaft and the second transition shaft located in the corresponding limit spaces form rings, and outer diameters of the rings are greater than inner diameters of the through holes.

Furthermore, the end covers are fixed to outer surfaces of the base through screws.

Furthermore, the base is a housing defining a hollow chamber, and the power member and the middle shaft are both assembled in the hollow chamber.

By adopting the above-mentioned technical solutions, the beneficial effects of the inventive embodiment of the present invention are as follows. The two ends of the middle shaft of the embodiment of the present invention respectively form the first axis and the first shaft hole, the end of the first transition shaft connected to the middle shaft forms the second axis, and the end of the second transition shaft connected to the middle shaft defines the second shaft hole. The cross sections of the first shaft hole, the first axis, the second shaft hole, and the second axis are non-circular. Therefore, the power transmission efficiency of the at least one driving module is effectively improved, and the assembly of the at least one driving module is convenient. Moreover, a single driving module or a plurality of driving modules connected in combination can be used to meet different requirements of the winding force of various specifications of the curtain, and the structure of the driving mechanism is simple and reliable, and the assembly is convenient.

DETAILED DESCRIPTION OF THE INVENTION

Figure 1:
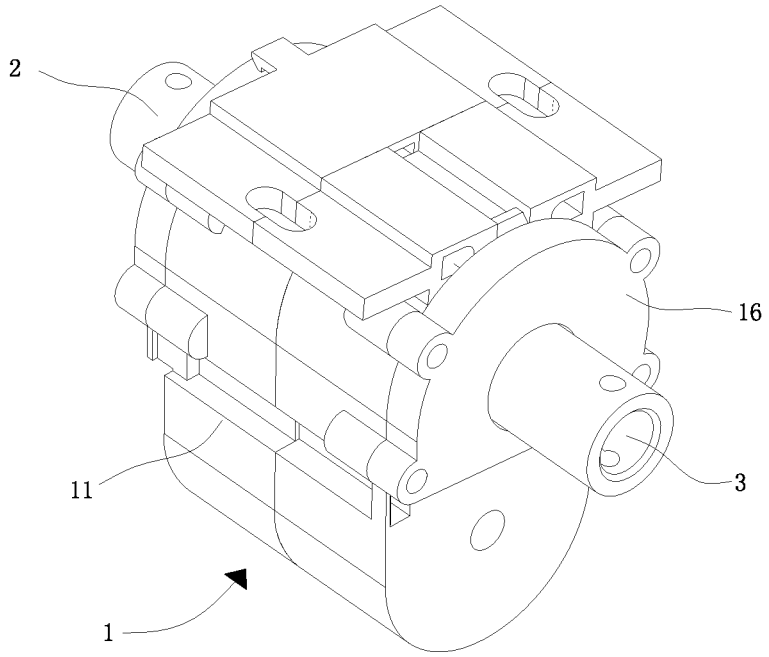
FIG. 1 is an isometric view of a driving mechanism for curtain cord winding reels of an embodiment of the present invention.
Figure 2:
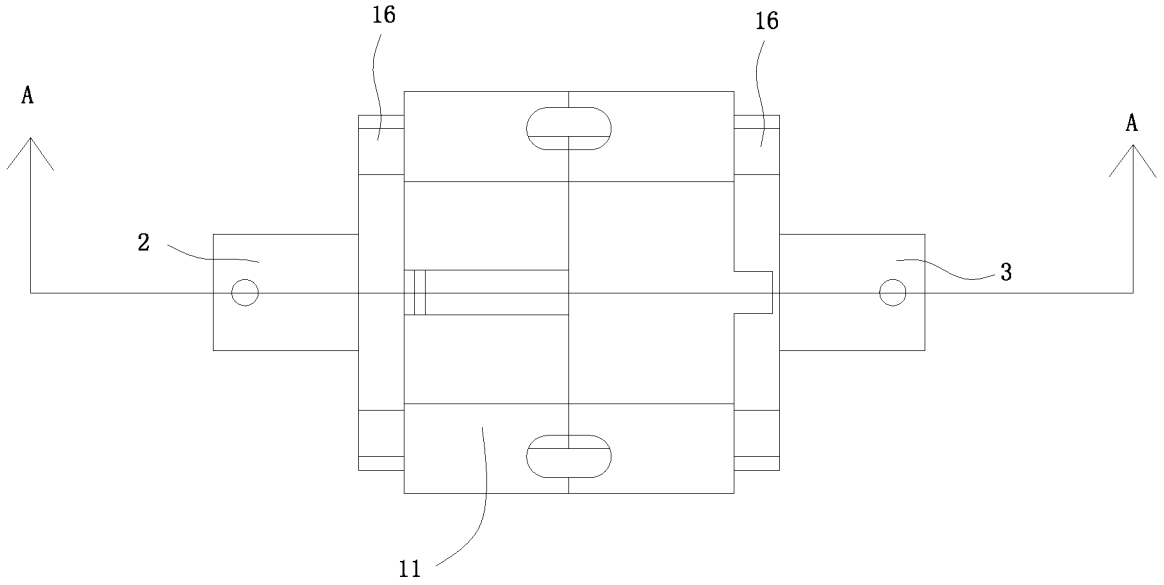
FIG. 2 is a top plan view of the driving mechanism for curtain cord winding reels of the embodiment of the present invention.

The present application will be further described in detail below with reference to the accompanying drawings and specific embodiments. It should be understood that the following illustrative embodiments and illustrations are only used to explain the present invention and are not intended to limit the invention, and that the features of the embodiments and embodiments of the present application may be combined with each other.

Referring to FIGS. 1-6, an embodiment of a driving mechanism for curtain cord winding reels 50 of the present disclosure includes at least one driving module 1, and first and second transition shafts 2 and 3 respectively mounted to two sides of the at least one driving module 1 and connected to the cord winding reel 50 by drive connection. Each driving module 1 includes a base 11, a power member 12 assembled in the base 11, and a middle shaft 13 connected to the power member 12 mounted to two sides of the base 11 with two opposite ends. The base 11 includes a first part 11 *a* and a second part 11 *b*.

First and second ends of the middle shaft 13 are respectively extended out of the first part 11 *a* and the second part 11 *b* of the base 11. An end surface of the first end of the middle shaft 13 defines a first shaft hole 131, and the second end of the middle shaft 13 forms a first axis 132. The first transition shaft 2 and the second transition shaft 3 are respectively connected to the first end and the second end of the middle shaft 13. An end of the first transition shaft 2 connected to the middle shaft 13 forms a second axis 21. An end of the second transition shaft 3 connected to the middle shaft 13 defines a second shaft hole 31. Cross sections of the first shaft hole 131, the second shaft hole 31, the first axis 132, and the second axis 21 are matched with one another, and the cross sections are non-circular, such as being triangular, pentagonal, hexagonal, rectangular, elliptical, convex, or other irregular shapes.

Figure 3:
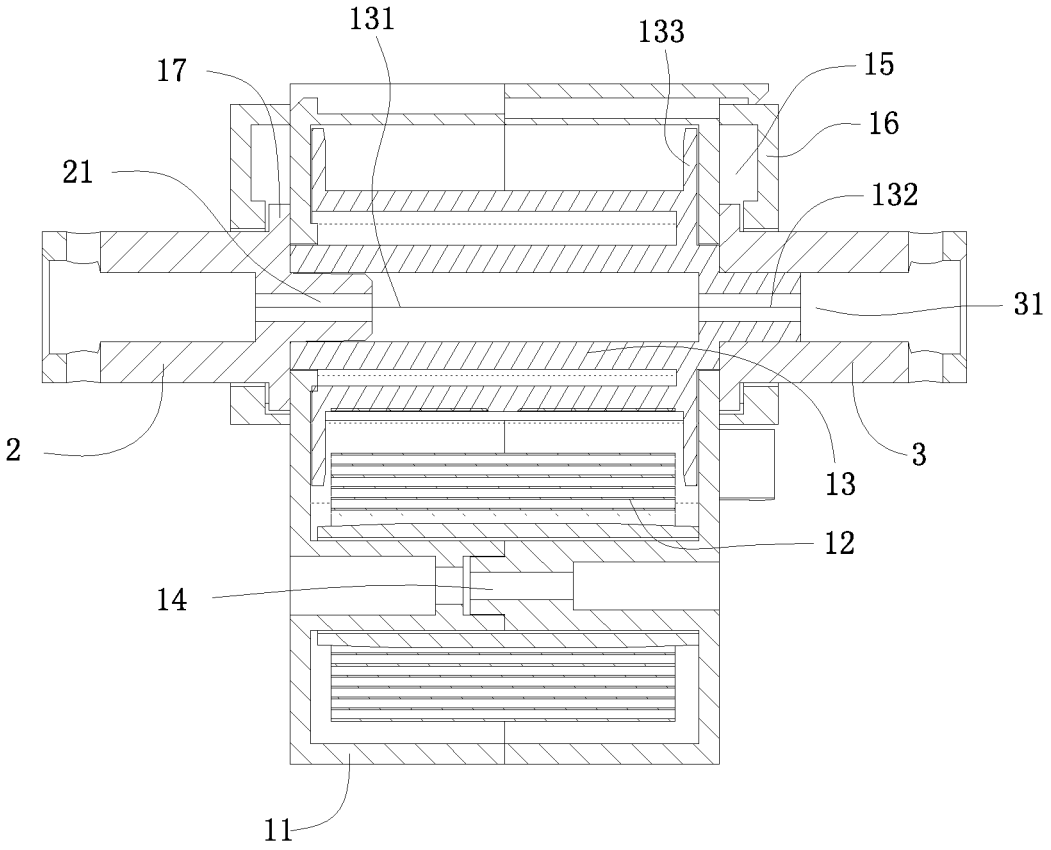
FIG. 3 is a cross-sectional view of FIG. 2, taken along the line of A-A.
Figure 4:
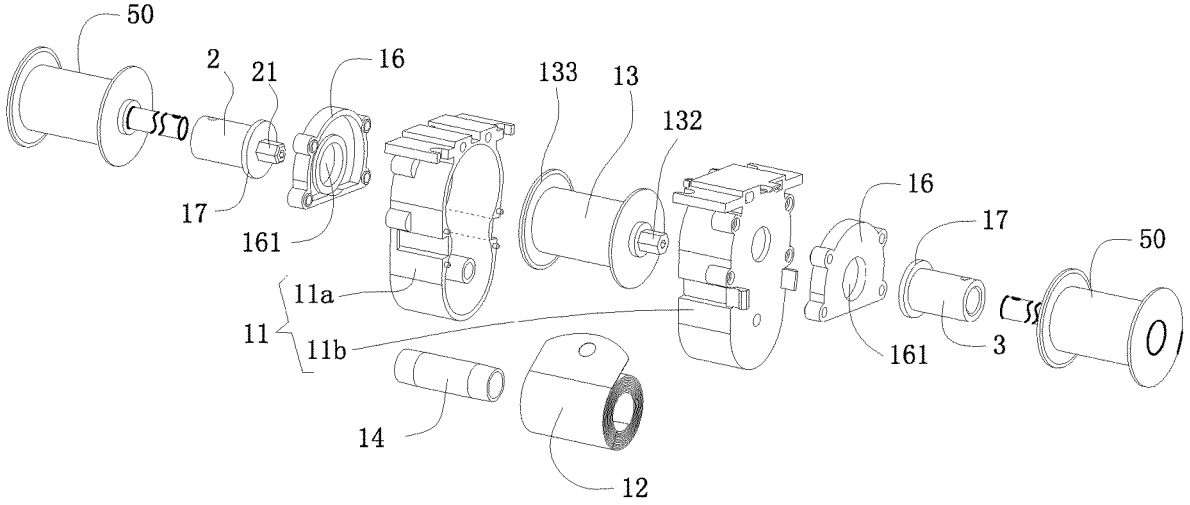
FIG. 4 is an exploded view of the driving mechanism of the embodiment of the present invention and two curtain cord winding reels.
Figure 5:
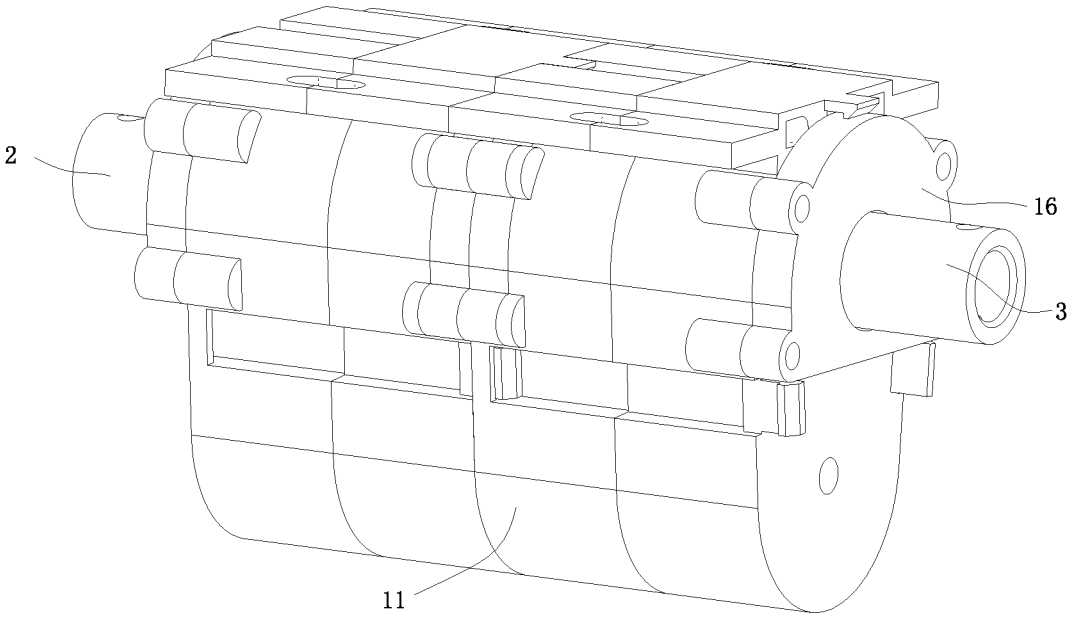
FIG. 5 is an assembled view of two driving modules of the driving mechanism for curtain cord winding reels of an embodiment of the present invention.
Figure 6:
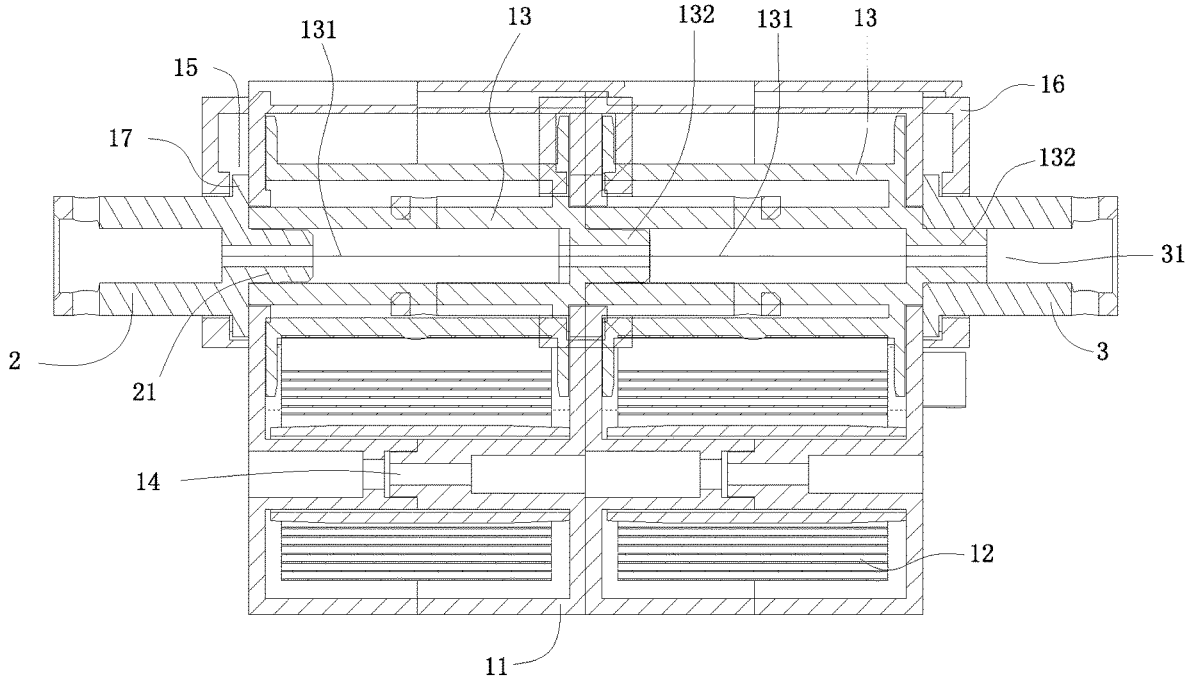
FIG. 6 is a cross-sectional view of the driving mechanism for curtain cord winding reels with two assembled driving modules.

Referring to FIG. 3, in an embodiment, the driving mechanism includes a driving module 1. Shapes of the cross sections of the first shaft hole 131, the second shaft hole 31, the first axis 132, and the second axis 21 are all regular hexagons, which can effectively avoid that the middle shaft 13 slides between the first transition shaft 2 and the second transition shaft 3 during the rotation process and avoid that the middle shaft 13 cannot drive the reels 50 to wind or unwind the drawstring because of the slide of the middle shaft 13. Therefore, the power transmission efficiency between the middle shaft 13 and the first and second transition shafts 2 and 3 can be effectively improved, and the assembly of the first shaft hole 131, the second shaft hole 31, the first axis 132, and the second axis 21 is convenient.

In the embodiment, the first axis 132 and the first shaft hole 131 are respectively disposed at two ends of the middle shaft 13, the second axis 21 is disposed at the end of the first transition shaft 2 connected to the middle shaft 13 and the second shaft hole 31 is disposed at the end of the second transition shaft 3 connected to the middle shaft 13, and cross sections of the first shaft hole 131, the second shaft hole 31, the first axis 132, and the second axis 21 are non-circular, so that the power transmission of the driving module 1 can be effectively improved and the assembly is convenient. In addition, a single driving module 1 or a plurality of driving modules 1 connected in combination can be used to meet different requirements of the winding force of various specifications of the curtain, and the structure of the driving mechanism 1 is simple and reliable, and the assembly is convenient.

In an alternative embodiment, the power member 12 is a clockwork spring. An inner end of the clockwork spring is assembled in the base 11 through a spring shaft 14, and an outer end of the clockwork spring is connected to the middle shaft 13.

In the embodiment, the clockwork spring is used as the power member 12 to drive the middle shaft 13 to rotate. In the specific implementation, the outer end of the clockwork spring is connected to the middle shaft 13. When the drawstring of the curtain is manually pulled to rotate the reels 50 thereby closing the curtain, the reels 50 will drive the middle shaft 13 to rotate together to cause the clockwork spring to be deformed and wound on the middle shaft 13. The drawstring is tied to a desired position, the curtain is then closed. When the curtain needs to be opened, the drawstring only needs to be untied, and the middle shaft 13 then rotates in the opposite direction under the elastic force of the clockwork spring itself to drive the reels 50 to rotate in the opposite direction. The reels 50 release the drawstring, and the curtain is automatically opened. It can be understood that the power member 12 can also be set as a motor or other power devices that can drive the middle shaft 13 to rotate.

In an alternative embodiment, the middle shaft 13 includes two end plates 133 located at the ends of the middle shaft 13. An outer surface of the middle shaft 13 is connected to the outer end of the clockwork spring and cooperates with inner side surfaces of the two end plates 133 to form a winding space for accommodating the clockwork spring.

In the embodiment, the middle shaft 13 provides the end plates 133 at the ends to form the winding space for accommodating the clockwork spring when the middle shaft 13 rotates, which can effectively avoid that the clockwork spring slides relative to the middle shaft 13 under its own elastic force when the clockwork spring is wound on the middle shaft 13 and avoid that the curtain cannot be closed or opened because of the slide of the clockwork spring, so as to improve the stability of the driving mechanism.

In an alternative embodiment, the driving mechanism includes two or more driving modules 1. The two or more driving modules 1 are connected in series to form a long strip of driving module group. The first axis 132 at the second end of each of the driving modules 1 that are sequentially connected is engaged in the first shaft hole 131 of the first end of the middle shaft 13 of an adjacent driving module 1. The first axis 132 of the second end of the driving module 1 located at the foremost end of the driving module group is correspondingly engaged in the second shaft hole 31 of the second transition shaft 3. The second shaft 21 of the first transition shaft 2 is engaged in first shaft hole 132 of the first end of the driving module 1 at the rear end of the driving module group.

In the embodiment, the two or more driving modules 1 are sequentially connected to form the long drive module group. The driving module group includes a long middle shaft assembly that is sequentially connected by a plurality of middle shafts 13, and a plurality of power members 12 that is connected to the middle shafts 13 of the middle shaft assembly to synchronously drive the middle shaft assembly to rotate. The power members 12 cooperate on the middle shafts 13 to enhance the driving force applied on the middle shaft assembly. Therefore, the winding force of the driving mechanism is enhanced, thereby realizing the closing of the curtains of different specifications, so as to effectively improve the practicality of the driving mechanism.

In an alternative embodiment, two end covers 16 are respectively mounted to outer surfaces of the first part 11*a* and the second part 11*b* of the base 11 to define two limit spaces 15 together with the base 11, to respectively limit the first transition shaft 2 and the second transition shaft 3. The end covers 16 define through holes 161 through which the first transition shaft 2 and the second transition shaft 3 respectively extend out of the corresponding limit spaces 15. Ends of the first transition shaft 2 and the second transition shaft 3 located in the corresponding limit spaces 15 form rings 17, and outer diameters of the rings 17 are greater than inner diameters of the through holes 161.

In the embodiment, the limiting spaces 15 are defined by assembling the base 11 and the end covers 16, to limit and assemble the first transition shaft 2 and the second transition shaft 3. The ends of the first transition shaft 2 and the second transition shaft 3 extend through the through holes 161 of the corresponding end covers 16, and the opposite ends of the first transition shaft 2 and the second transition shaft 3 located in the limit spaces form the rings 17 having the outer diameters greater than the inner diameters of the through holes 161, which can effectively improve the assembly structure strength of the end covers 16 to the first transition shaft 2 and the second transition shaft 3, and improve stability of the driving mechanism.

In an alternative embodiment, the end covers 16 are fixed to outer surfaces of the base 11 through screws (not shown). In the embodiment, the end covers 16 are assembled to the outer surfaces of the base 11 by screws, can be detached from the base 11 by removing the screws to realize the maintenance and repair of the first transition shaft 2 and the second transition shaft 3, and the structure is simple and reliable.

In an alternative embodiment, the base 11 is a housing defining a hollow chamber enclosed by the first part 11 a and the second part 11*b*, and the power member 12 and the middle shaft 13 are both assembled in the hollow chamber.

In the embodiment, the base 11 includes the housing defining the hollow chamber and the power member 12 and the middle shaft 13 are assembled in the hollow chamber, which provides a good working environment for the power member 12 and the middle shaft 13 to avoid the occurrence of falling ash, etc., thereby avoid reducing the performance of the power member 12 or the middle shaft 13. Therefore, the service life of the driving mechanism is improved.

The specific embodiments described above further explain the objectives, technical solutions, and beneficial effects of the present invention. It is to be understood that the foregoing description is only specific embodiments of the present invention, and is not intended to limit the scope of the present invention. Any modifications, equivalent substitutions, improvements made within the spirit and scope of the present invention are intended to be included in the scope of the present invention.

What is claimed is:

1. A driving mechanism for curtain cord winding reels, comprising:

at least one driving module each comprising a base, a power member assembled in the base, and a middle shaft connected to the power member, wherein the base comprises a first part and a second part, the first part and the second part enclose a hollow chamber for assembling the power member and the middle shaft, wherein first and second ends of the middle shaft are respectively mounted to the first part and the second part, and the second end of the middle shaft extends out of the second part of the base an end surface of the first end defines a first shaft hole, the second end forms a first axis;

a first end cover and a second end cover, wherein the first end cover is mounted to an outer surface of the first part of the base opposite to the second part, the second cover is mounted to an outer surface of the second part of the base opposite to the first part, wherein the first end cover and the first part of the base enclose a first limit space, the second end cover and the second part of the base enclose a second limit space; and first and second transition shafts respectively mounted to two sides of the at least one driving module and connected to the cord winding reels, wherein the first and second transition shafts are respectively received in the first and second limit spaces and connected to the first and second ends of the middle shaft, an end of the first transition shaft connected to the middle shaft forms a second axis, an end of the second transition shaft connected to the middle shaft defines a second shaft hole, cross sections of the first shaft hole, the second shaft hole, the first axis, and the second axis are matched with one another, and the cross sections are non-circular.

2. The driving mechanism for curtain cord winding reels of claim 1, wherein the power member is a clockwork spring, an inner end of the clockwork spring is connected in the hollow chamber of the base through a spring shaft, and an outer end of the clockwork spring is connected to the middle shaft.

3. The driving mechanism for curtain cord winding reels of claim 2, wherein the middle shaft comprises two end plates respectively formed at the first and second ends of the middle shaft, an outer surface of the middle shaft is connected to the outer end of the clockwork spring and cooperates with inner side surfaces of the two end plates to form a winding space for accommodating the clockwork spring.

4. The driving mechanism for curtain cord winding reels of claim 1, wherein the at least one driving module comprises two or more driving modules, the two or more driving modules are connected in series to form a long strip of drive module group, the first axis at the second end of each of the two or more driving modules that are sequentially connected is engaged in the first shaft hole of the first end of the middle shaft of an adjacent driving module, the first axis of the second end of the driving module located at the foremost end of the driving module group is correspondingly engaged in the second shaft hole of the second transition shaft, the second axis of the first transition shaft is engaged in first shaft hole of the first end of the driving module at the rear end of the drive module group.

5. The driving mechanism for curtain cord winding reels of claim 1, wherein the first and second end covers define through holes through which the first transition shaft and the second transition shaft respectively extend out of the corresponding first and second limit spaces, ends of the first transition shaft and the second transition shaft located in the corresponding first and second limit spaces form rings, and outer diameters of the rings are greater than inner diameters of the through holes.

6. The driving mechanism for curtain cord winding reels of claim 5, wherein the first and second end covers are respectively fixed to the outer surfaces of the first part and the second part of the base through screws.

7. The driving mechanism for curtain cord winding reels of claim 4, wherein the first and second end covers define through holes through which the first transition shaft and the second transition shaft respectively extend out of the corresponding first and second limit spaces, ends of the first transition shaft and the second transition shaft located in the corresponding first and second limit spaces form rings, and outer diameters of the rings are greater than inner diameters of the through holes.

8. The driving mechanism for curtain cord winding reels of claim 7, wherein the first and second end covers are respectively fixed to the outer surfaces of the first and second parts of the base through screws.

* * * * *